US005212470A

United States Patent [19]

Thuillard

[11] Patent Number: 5,212,470

[45] Date of Patent: May 18, 1993

[54] SUPERVISED FIRE ALARM SYSTEM

[75] Inventor: Marc Thuillard, Mannedorf, Switzerland

[73] Assignee: Cerberus Ltd., Mannedorf, Switzerland

[21] Appl. No.: 749,598

[22] Filed: Aug. 26, 1991

Related U.S. Application Data

[63] Continuation of Ser. No. 582,620, Sep. 14, 1990, abandoned.

[30] Foreign Application Priority Data

Aug. 13, 1990 [CH] Switzerland ..... 3372/89

[51] Int. Cl.[5] ..... G08B 17/10

[52] U.S. Cl. ..... 340/629; 340/628; 250/381

[58] Field of Search ..... 340/628, 629, 661, 662; 250/381, 382

[56] References Cited

U.S. PATENT DOCUMENTS 3,676,678 7/1972 Takahashi ..... 340/629 X

FOREIGN PATENT DOCUMENTS 2010105 8/1990 Canada .
384209 8/1990 European Pat. Off. .
2019791 11/1970 Fed. Rep. of Germany .
2636778 4/1979 Fed. Rep. of Germany .
2274982 2/1976 France .
2362454 4/1978 France .
572644 2/1976 Switzerland .
583445 12/1976 Switzerland .
1478952 7/1977 United Kingdom .

*Primary Examiner*—Jin F. Ng
*Assistant Examiner*—Jeffery A. Hofsass
*Attorney, Agent, or Firm*—Brumbaugh, Graves, Donohue & Raymond

[57] ABSTRACT

A fire alarm system having increased immunity to false alarms comprises control and indicating means (6) and a plurality of ionization smoke detectors (7) connected through signal lines (8, 9, 14) with the control and indicating means (6), each ionization smoke detector (7) comprising an ionization measurement chamber (1) for producing an electrical signal having a characteristic indicative of a monitored condition, a radioactive source (10) to ionize the air in the ionization measurement chamber (1), and an evaluation circuit comprising an amplifier element (3) to amplify the electrical signal from the ionization measurement chamber (1), threshold detection means (15, 16) for comparing the electrical signal characteristic to minimum and maximum limits and for producing an alarm or trouble signal, and electronic means (5, 11) by which the chamber voltage (UK) of the ionization measurement chamber (1) is increased as far as possible to the saturation range of the ionization chamber (1) if the ionization current in the ionization chamber (1) is reduced. From the current which flows at increased chamber voltage (UK2) it can be determined whether the saturation current (Is) of the ionization chamber (1) has fallen compared with given predetermined values. If the saturation current (Is) of the ionization chamber (1) has fallen compared with given predetermined values, a malfunction has occurred, for example, due to the covering of the radioactive source (10); if not, then an alarm signal is transmitted.

12 Claims, 3 Drawing Sheets

SUPERVISED FIRE ALARM SYSTEM

This application is a continuation of application Ser. No. 07/582,620, filed on Sep. 14, 1990 now abandoned.

BACKGROUND OF THE INVENTION

This invention relates to a supervised fire alarm system in accordance with the general concept set forth hereinbelow, in which a plurality of ionization smoke detectors which may have different electrical states are connected through signal lines with control and indicating means.

Ionization type fire detectors, in which a radioactive substance generates ions, are so arranged that, upon application of an electric voltage between the electrodes of the ionization chambers, a current is generated which decreases upon penetration of smoke, or fire aerosols, into the chamber. A fire alarm system of the described type is disclosed, for instance, in U.S. Pat. No. 3,964,036.

Decrease of ion current in the ionization chamber is detected by an electrical circuit which includes a threshold detector. Upon detection, an alarm circuit can be activated. In one form the ionization chamber is connected in series with a resistance element (i.e. a load resistor). The relative voltage drops across the ionization chamber and the load resistor are sensed and applied to a threshold detector, for example, a field effect transistor (FET). If the voltage drop across the ionization measurement chamber rises, due to an increase in its resistance, the threshold value of the FET is exceeded, it begins to become conductive, and provides a fire alarm signal.

Known ionization type fire detectors are connected through signal lines to control and indication equipment (CIE). The increased FET current is conducted directly to the control and indication equipment, or over a further switching element, e.g. a monoflop with delay, or the like. The control and indicating equipment provides an alarm signal.

A problem which arises with all fire alarm systems is the occurrence of false alarms. With ionization smoke detectors there is the special problem that the detectors are sensitive to fast air currents, condensation and to the formation of a layer of dust or corrosion on the radioactive source, as these pheonmena have the same effect on the ionization current as fire aerosols. Because such a change in the ionization current increases detector sensitivity, there is an increased tendency for false alarms. The occurrence of false alarms is particularly troublesome if, as a result of an alarm, an automatic extinguishing system is activated or external fire-fighting forces are called out.

Success has been achieved in countering false slits in the sampling chamber, e.g. according to DE 2,415,479. In order to avoid the malfunctioning of ionization smoke detectors by the formation of condensation, the electrodes were heated, or the heat normally lost by the electronic circuit was utilized for heating as was suggested in DE 2,537,598.

In EP 070,449 it was suggested that the measured values be evaluated after transmission to a control unit. From the individual measured values a quiescent value for each detector is given and stored in a quiescent value memory. From the detector measured value and a comparative value stored in a comparator memory, a new comparative value is given and entered in the comparator memory. After comparing the new comparative value with a maximum rating, either a display device is activated or, from the latest detector measured value and the stored quiescent value, a new quiescent value is given and entered in the quiescent value memory. In this way it is possible to compensate for a slow change to the detector and maintain stable detector sensitivity over a long period.

In DE 2,428,325 it was suggested that condensation and degradation of insulation in the sampling chamber be avoided by using a condensation-resistant chemical compound on the plate separating the sampling and reference chambers.

In Jap. Patent Application No. JP-47-93018, it was suggested that to counter false alarms cause by soiling of the radioactive source, the dimensions of the leakage paths between the middle electrode and the two other electrodes be modified to correspond to the ratio between the chamber voltages so that, with uniform soiling, no voltage shift to the middle electrode occurs.

In order to prevent condensation of the radioactive source, which would impair the operation of the ionization smoke detector, it is suggested in DE 1,101,370 that a ring-shaped protective electrode connected to a bias voltage be installed facing the conductive source support plate. The electrical field this creates should prevent the formation of condensation on the radioactive source.

DE 2,423,046 discloses an ionization smoke detector having a protective ring system to signal any reduced insulating resistance of the sampling chamber caused by condensation or dust accumulation. A change in the potential difference between the protective ring system and the connection point between sampling and reference chambers is evaluated by the control unit as a problem indicator.

A fire alarm system is described in U.S. Pat. No. 3,964,036 in which the development of the amplified signal from the ionization smoke detector is displayed and printed out. The signal curve received is compared with known curves produced by soiling or condensation to differentiate a false alarm from a genuine alarm. This form of false alarm recognition is costly and time consuming both technically and in terms of personnel.

None of the fire alarm systems described can indicate immediately and automatically whether or not a change in the ionization current in the sampling chamber signifies a false alarm or a genuine alarm caused by a fire.

Therefore, with the foregoing in mind, it is a primary object of this invention to provide a new and improved fire detector which avoids the disadvantages of known fire detectors and which can differentiate between a genuine alarm caused by fire phenomena and a false alarm caused by the covering of the radioactive source.

SUMMARY OF THE INVENTION

Now, in order to implement these and still further objects of this invention, which will become more readily apparent as the description proceeds, the fire alarm system of the present invention comprises control and indicating means (6) and a plurality of ionization smoke detectors (7), being connected through signal lines (8, 9, 14) with the control and indicating means (6), each ionization smoke detector (7) comprising an ionization measurement chamber (1) for producing an electrical signal having a characteristic indicative of a monitored condition, a radioactive source (10) to ionize the air in the ionization measurement chamber (1), and an evaluation circuit comprising an amplifier element (3) to amplify the electrical signal from the ionization measurement chamber (1), and threshold detection means (15, 16) for comparing the electrical signal characteristic to minimum and maximum limits and for producing an alarm or trouble signal, and is further characterized in that the evaluation circuit comprises electronic means (5, 11) adapted to change the supply voltage (U) of said ionization smoke detector (7) to two different supply voltages, electronic control means for signal evaluation adapted to compare those two currents measured at the two supply voltages with predetermined current values and transmitting an alarm signal to the control and indicating means (6) only if variations from the predetermined current values of the actual output signal of the amplifier element (3) are registered which show that there has been no significant reduction of the saturated current (Is) of the ionization measurement chamber (1).

According to a preferred embodiment of the fire alarm system according to the invention, the means of changing the supply voltage is located in the fire detectors.

A preferred design of the fire alarm system according to the invention locates the means of changing the supply voltage in the control means.

A further preferred design of the fire alarm system according to the invention locates the means of control for signal evaluation in the fire detectors.

In a particularly preferred design of the fire alarm system according to the invention, the evaluation circuit in the ionization smoke detector is adapted to transmit the output signal of the ionization measurement chamber amplifier element to the control and indicating equipment and the means of changing the supply voltage and the means of control for signal evaluation are located in the control and indicating means.

The invention and its mode of operation will be more fully understood from the following detailed description when taken with the accompanying drawings.

The invention will be better understood and objectives other than those set forth above will become apparent when consideration is given to the detailed description thereof. Such description makes reference to the annexed drawings. Throughout the various figures of the drawings the same reference characters have been generally used to denote the same or analogous components.

DETAILED DESCRIPTION OF THE PREFERRED EMBODIMENTS

Figure 1:
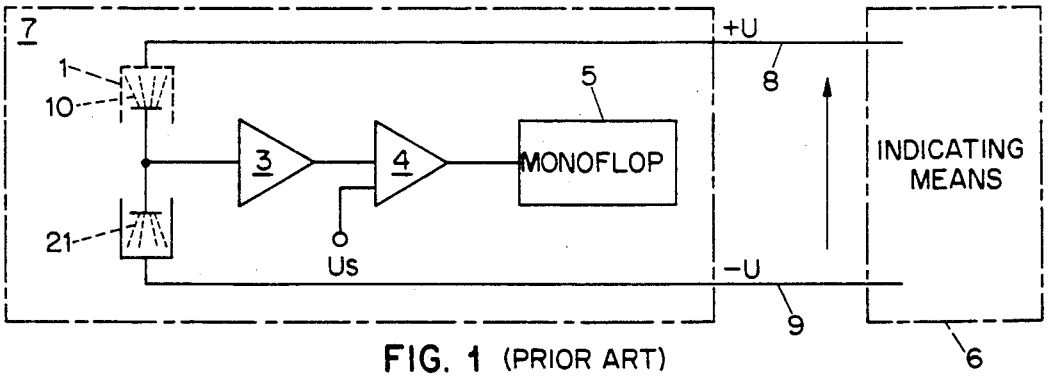
FIG. 1 (PRIOR ART)
FIG. 1 is a block diagram of a fire alarm system of the prior art.

FIG. 1 shows the block circuit diagram of a state-of-the-art fire alarm system. A series of ionization smoke detectors (7) is connected with the control and indicating means (6) via signal lines (8) and (9) which at the same time serve for power supply. FIG. 1 shows a single ionization smoke detector. An ionization measurement chamber (1) is connected to the supply voltage +U via a second ionization chamber (21) substantially closed to the environment which functions as a reference chamber. Changes to the voltage at the load resistor are measured by means of an amplifier element (3) and passed on to the threshold value detector (4). If the output voltage of the amplifier element (3) falls under the set threshold value Us, then the bistable switch (5) switches to alarm condition which is registered by the control and indicating means (6).

Figure 2:
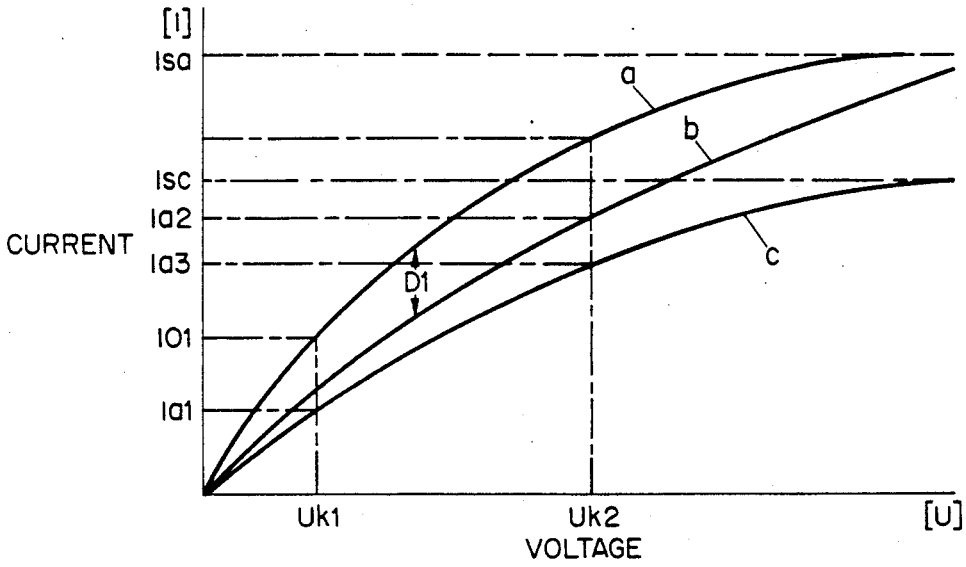
FIG. 2 shows a diagram of current-voltage curves of an ionization fire detector.

Curve "a" in FIG. 2 shows the current-voltage characteristic of an ionization measurement chamber in an ionization smoke detector according to FIG. 1. At first the chamber current increases linearly for low voltages and then changes to the saturation current Is. The saturation current Is is directly proportional to the number of ions generated and therefore also directly proportional to the activity of the radioactive source.

Curve "b" in FIG. 2 shows the current-voltage characteristic that results when a fire aerosol penetrates the ionization measurement chamber (1). The accumulation of the relatively large aerosol particles on the air ions greatly reduces their mobility. This in turn reduces the ion current. Curve "b" is below curve "a", but with higher chamber voltage, the chamber current changing to the same saturation current Is as with an unaffected ionization measurement chamber. In general, the relative current change DI/DO is given as a means of measuring the sensitivity of an ionization measurement chamber to smoke. It decreases with increasing chamber voltage, as is shown in curve "b". Curve "c" represents the current-voltage characteristic of an ionization measurement chamber (1) when the radioactive source (10) is covered. This situation is considered in more detail below in connection with FIG. 3.

Figure 3:
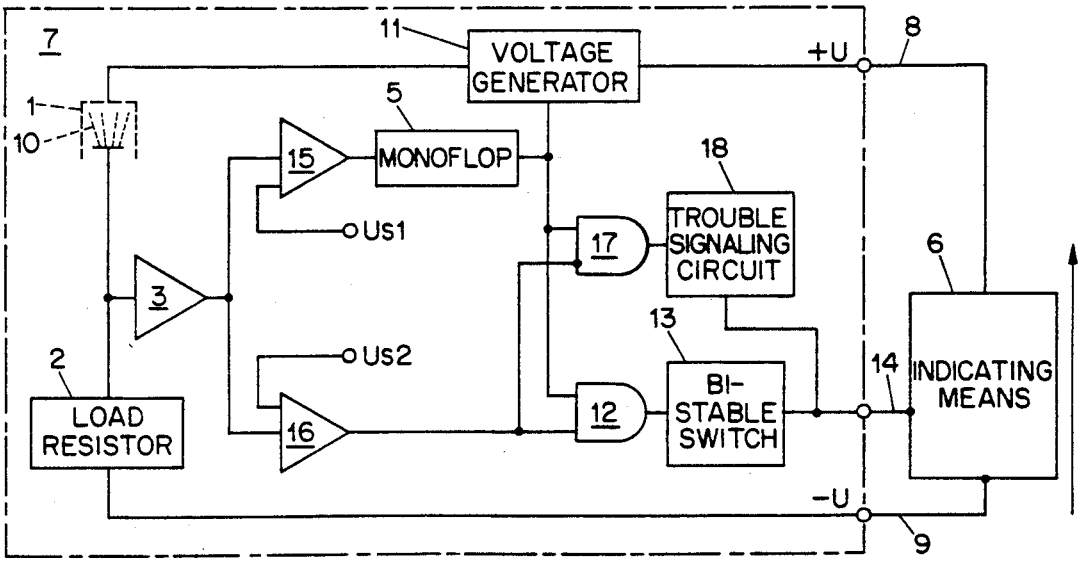
FIG. 3 is a block diagram of a fire alarm system according to the present invention.

In FIG. 3 and the following figures, identical reference symbols are used for the same or analog operating components. FIG. 3 shows an example of the layout of an ionization smoke detector (7) according to this invention.

The ionization smoke detector (7) has an ionization measurement chamber (1) with smoke entry slits which permit access of the ambient air to the ionization measurement chamber (1). The ionization measurement chamber (1) contains a radioactive source (10) to ionize the air in the ionization measurement chamber (1). The ionization measurement chamber (1) is connected in series with a high ohmic load resistor (2) between signal lines (8) and (9), which simultaneously serve for the power supply. An amplifier element (3), is connected at the junction point between the ionization measurement chamber (1) and load resistor (2). The output of the amplifier element (3) is connected to an input of two comparators (15) and (16). The voltage Us1, which determines the alarm threshold of the ionization smoke detector, is connected to the first input of the first comparator (15). Voltage Us2, which determines the monitoring threshold for the saturation current Is, is connected to the second input of the second comparator (16). The output of the first comparator (15) is connected to a monoflop (5) whose time constant is greater than the time required to monitor the saturation current. The monoflop (5) output is on the one hand connected to a voltage generator (11) which in turn is connected to the supply voltage +U supplied by signal line (8) and on the other hand to an input of an AND gate (12). The output of the second comparator (16) is connected to the other input of the AND gate (12). The output of the AND gate (12) is connected to a bistable switch (13) which in turn is connected via another signal line (14) to the control unit (6).

Through voltage generator (11) it is possible to apply two different voltages to the ionization smoke detector. The amplifier element (3) increases the voltage at the connection point between the ionization measurement chamber (1) and the load resistor (2) to a value suitable for comparison with the alarm threshold Us1 and the monitoring threshold Us2 for the saturation current.

In normal operating condition, at the output of the voltage generator (11) the voltage U1, which determines the operating point of the ionization measurement chamber (1), is generated. This value is so chosen that the ionization measurement chamber (1) is operated at a higher level of sensitivity to smoke. The chamber current produces a voltage drop U0 at the load resistor (2) which is greater than US1. In this case the logic voltage 0 is applied to the inputs of the AND gate 12 and consequently, its output shows also the logic voltage 0.

Before the operating principle of the fire alarm system according to the invention is explained, it is necessary to consider the effect of the radioactive source being covered (whether by dirt or condensation) on the characteristic of an ionization measurement chamber. In FIG. 2, curve "a" shows the development of the ionization current in relation to chamber voltage without smoke and without the radioactive source being covered. Curve "b" shows the change in characteristic caused by smoke without the radioactive source being covered, and curve "c" shows the change caused by the radioactive source being covered without smoke.

As can be seen, curves "a" and "b" have approximately the same saturation current Isa, i.e. the saturation current is virtually independent of the smoke concentration. If, however, the ionization of the air in the ionization measurement chamber (1) is reduced by the covering of the radioactive source, this causes a greatly reduced saturation current Isc. On the other hand, at the beginning of the current-voltage characteristic, there is practically no difference between curves "b" and "c". A differentiation can be made between one voltage reduction caused by the penetration of smoke in the ionization measurement chamber (1), or by the covering of the radioactive source (10), according to the invention, by measuring the chamber current at two different chamber voltages UK1 and UK2, whereby voltage UK1 is the normal voltage which sets the operating point of the ionization measurement chamber (1) at a level of higher sensitivity to smoke and whereby voltage UK2 is a higher voltage than UK1, which brings the ionization measurement chamber (1) as far as possible within the range of the saturation current Is.

As the current-voltage characteristics of the ionization chamber (1) are known with and without smoke, it is a simple matter to calculate the saturation current Is from current Ia2 at the increased chamber voltage UK2. If, after increasing the supply voltage (U) of the ionization smoke detector (7) which causes an increase of the chamber voltage from UK1 to UK2, a reduction of the saturation current Is is determined, then the change to the voltage at the load resistor (2) is not due to the penetration of smoke into the ionization measurement chamber (1), rather it must have another cause, such as the covering of the radioactive source (10) or a leakage current from amplifier element (3).

In quiescent condition a voltage is connected to the ionization measurement chamber and a current can be measured. If the ionic current in the ionization chamber (1) changes, then the output signal of the amplifier element (3) changes accordingly. If the output signal of the amplifier (3) falls under Us1 then a signal is activated from which it is initially unclear whether it is an alarm signal or a trouble signal. The supply voltage is then increased by the voltage generator (11) to an increased value, and the voltage drop at the load resistor (2) is measured at this increased voltage. If the output signal of i the amplifier (3) falls to a value above US2, then the penetration of smoke was responsible for the reduction in current and the signal is interpreted as an alarm signal. If, however, the output signal of the amplifier (3) falls under the value Us2, then a reduction of the saturation current must have taken place and the covering of the radioactive source (10) by condensation or dirt must have been the reason for the reduction in current. Thus the signal will not be interpreted as an alarm; instead, if required, the signal may be displayed as trouble or a problem.

The aim of the invention is thus achieved, namely the avoidance of false alarms through covering of the radioactive source. It will be clear that the measurement of the differences in current is simplified, as a greater voltage for the increased supply voltage is chosen. Therefore, measurement at saturation level is especially suitable.

Below is described the situation in which smoke penetrates the ionization measurement chamber (1). In this case the voltage at the load resistor (2) drops. If the alarm threshold Us1 is reached, the monoflop (5) is activated via the first comparator (15) and the logic voltage 1 connected to the input of the AND gate (12). At the same time the voltage generator (11) switches the ionization smoke detector supply voltage to an increased value. This value is so chosen that as far as possible the ionization measurement chamber (7) is operated in the saturated state.

The voltage drop at the load resistor (2) increases to the saturation value and, if the radioactive source is not covered, exceeds the monitoring value Us2. Then the second comparator (16) switches over the logic voltage value 1 to the second input of the AND gate (12). As the AND condition has now been met, the bistable switch (13) switches to alarm condition.

If the voltage drop at the load resistor (2) is not due to the penetration of smoke, but is rather due to soiling or condensation on the radioactive source (10), then the voltage at the output of the amplifier element (3) after switchover of the supply voltage (U) to the increased voltage does not exceed the monitoring voltage Us2. The second comparator (16) does not switch over the logic voltage 1 to the second input of the AND gate (12) and as a result no alarm is activated. In this case the monoflop (5) switches the voltage generator (11) back to the normal operating voltage (U) and the ionization measurement chamber operates again in the range of high sensitivity to smoke. A new measuring or monitoring cycle begins. The procedure described here must be repeated if the condensation or soiling of the radioactive source (10) continues.

In order that the control and indicating means (6) can recognize that the ionization smoke detector (7) is operating correctly, a second AND gate (17) with negation of the second input (connected to the second comparator (16)) may be connected in parallel with the AND gate (12), the output of which is connected to a trouble or problem signal transmission circuit (18). Should the logic voltage value 1 only be connected to the first input of AND gates (12) and (17), but the logic value 0 be connected to the other input, a signal is given by the AND gate (17) to the trouble or problem signal transmission circuit (18), which passes on a trouble signal which is different from the alarm signal to the control and indicating equipment means (6) via signal line (14). The trouble signal transmission circuit (18) has a delay element which is designed to ensure that the measuring or monitoring cycle is completed at least once.

Thus, monitoring the saturation current either confirms or prevents an alarm signal, and if required, a problem or trouble with the ionization smoke detector is indicated.

Based upon the foregoing, it will be apparent to those skilled in the art that the operation of the fire alarm system of this invention is basically as follows. During normal operation (i.e. non-smoke and non-covered detector), the voltage at the exit of amplifier (3) is between reference voltages Us1 and Us2; thus comparators (15) and (16) each give a logic output of 0, and neither of AND gates (12) or (17) output a signal to produce a corresponding "smoke" or "trouble" alarm, respectively. However, if the ionic current drops in ionization chamber (1) to produce a voltage less than reference voltage Us1, comparator (15) gives a logic output of 1, which is in turn relayed to monoflop (5), and which in turn causes voltage generator (11) to step up the voltage to chamber (1) to an increased voltage. If the voltage exiting amplifier (3) now exceeds reference voltage Us2, comparator (16) gives a logic output of 1 to AND gate (12), which also receives a logic output of 1 from monoflop (5). AND gate (12) thus outputs a logic output of 1, and bistable switch (13) causes a "smoke" alarm. However, if the voltage exiting amplifier (3) is less than reference voltage Us2, comparator (16) gives a logic output of 0 to AND gate (12), and a logic output of 1 to (inverse) AND gate (17). As AND gate (17) already receives a logic output of 1 from monoflop (5), trouble transmission circuit (18) is activated instead of the "smoke" alarm circuit via bistable switch (13).

The means of checking the signals can also be located in the control and indicating means (6). In this case, the ionization smoke detector (7) contains suitable transmission electronics which transmit the voltage at the load resistor (2) by digital or analog signal to the control and indicating means (6). Similarly, the switchover of the supply voltage can either take place at the control and indicating means (6), or can be activated in the ionization smoke detector (7) by means of a signal from the control and indicating means (6).

Figure 4:
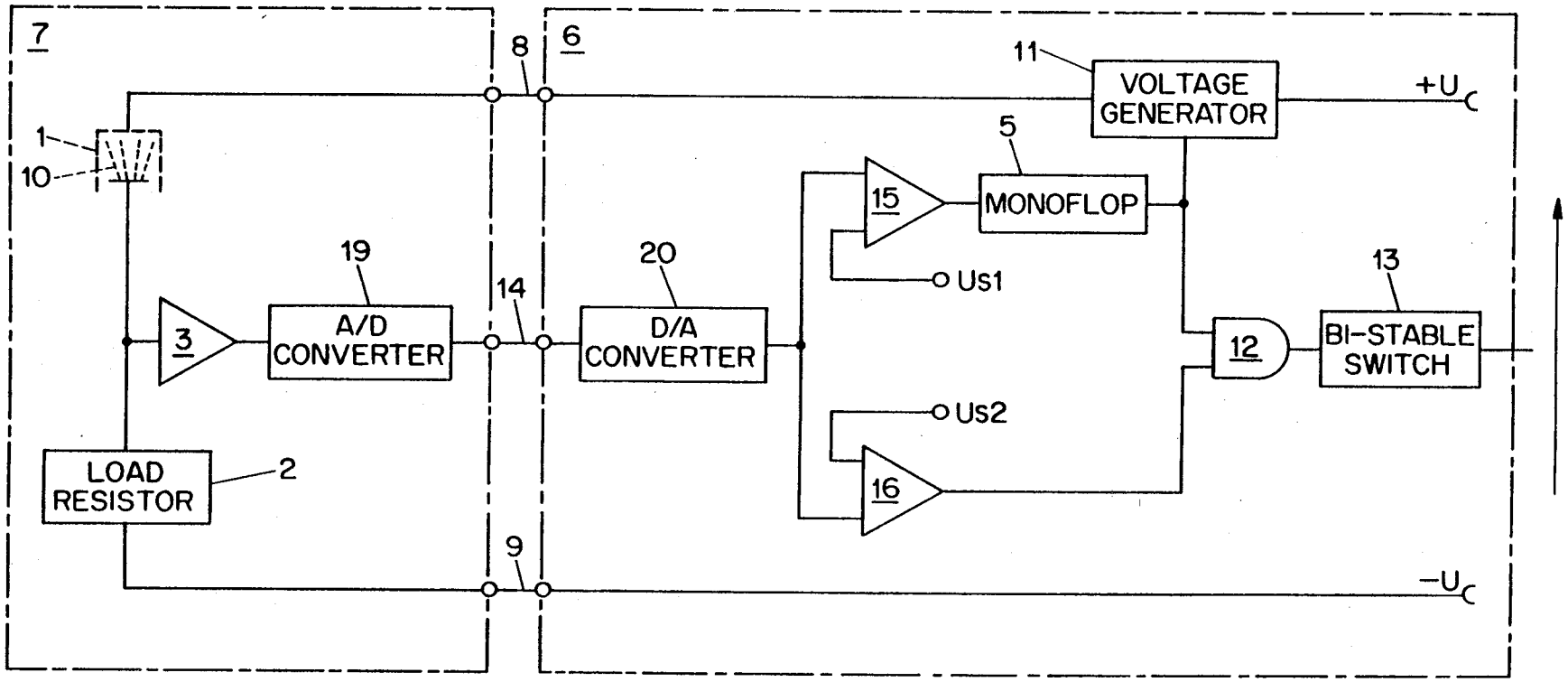
FIG. 4 shows a block diagram of a further embodiment of a fire alarm system of the invention.

FIG. 4 shows a fire alarm system of this invention in which the ionization smoke detector (7) which (as in the design in FIG. 3) has an ionization measurement chamber (1) with smoke entry slits that permit the ambient air to enter the ionization measurement chamber (1). The ionization measurement chamber (1) contains a radioactive source (10) to ionize the air in the ionization measurement chamber (1). The ionization measurement chamber (1) is connected in series with a high ohmic load resistor (2) between two signal lines (8) and (9), which simultaneously serve to provide the power supply. An amplifier element (3), is connected at the junction point between the ionization measurement chamber (1) and the load resistor (2). However, the output of this amplifier element (3) is in this case connected to an analog/digital converter (19), which via signal line 14, passes on a pending analog signal at the output of the amplifier element (3) in digital form to the control and indicating means (6).

At the control and indicating means (6), the digital signal is converted by a digital/analog converter (20) back into an analog signal and (as with the design in FIG. 3) transmitted to two comparators (15) and (16). Further signal processing corresponds roughly to that in FIG. 3, whereby the voltage generator (11) is in the control and indicating means (6).

Figure 5:
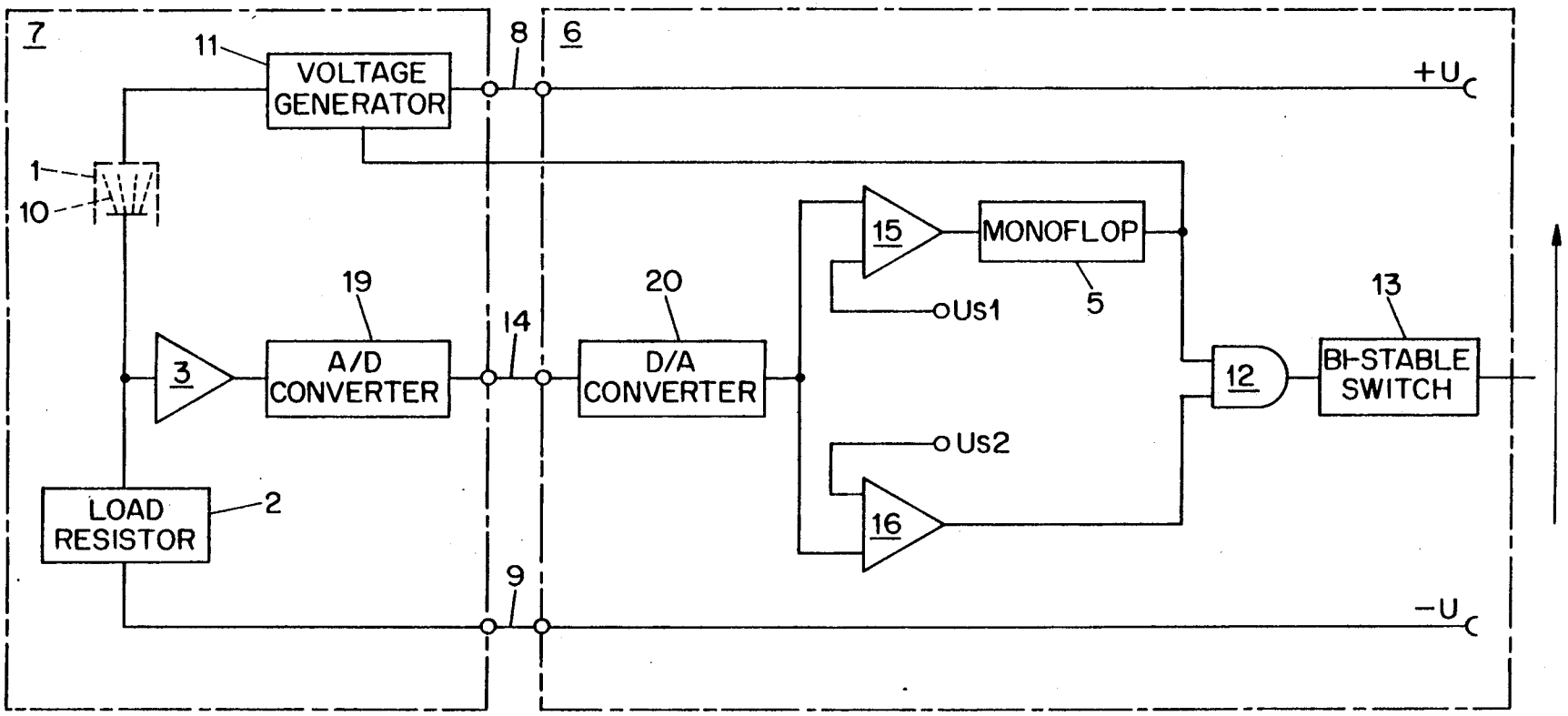
FIG. 5 shows a block diagram of a still further embodiment of a fire alarm system of the invention.

FIG. 5 shows another arrangement of a fire alarm system according to this invention, which basically corresponds to the arrangement in FIG. 4. The only difference is that the voltage generator (11) is not located in the control and indicating means (6), rather in the fire detector (7).

While particular embodiments of the invention have been described, various modifications will be apparent to those skilled in the art, and therefore it is not intended that this invention be limited to the described embodiments or to details thereof, and departures may be made therefrom within the spirit and scope of the invention.

I claim:

1. A fire alarm system comprising:

(a) control and indicating means (6); and (b) a plurality of ionization smoke detectors (7), being connected through signal lines (8, 9, 14) with said control and indicating means (6), each ionization smoke detector (7) comprising:

(i) an ionization measurement chamber (1) for producing an electrical signal having a characteristic indicative of a monitored condition, (ii) a radioactive source (10) to ionize the air in the ionization measurement chamber (1), and (iii) an evaluation circuit comprising:

(A) an amplifier element (3) to amplify the electrical signal from the ionization measurement chamber (1), and (B) threshold detection means (15, 16) for comparing the electrical signal characteristic to minimum and maximum limits and for producing an alarm or trouble signal, (C) electronic means (5, 11) adapted to change the supply voltage (U) of said ionization smoke detector (7) to a first supply voltage and an increased second supply voltage, and (D) electronic control means for signal evaluation adapted to compare the corresponding two currents measured at said two different supply voltages with predetermined current values and to transmit an alarm signal to said control and indicating means (6) only if variations from the predetermined current values of the actual output signal of the amplifier element (3) caused by the increased second supply voltage demonstrates that there has been no significant reduction of the saturated current (Is) of said ionization measurement chamber (1) after the supply voltage has been increased to said second supply voltage.

2. A fire alarm system according to claim 1, wherein the electronic control means for signal evaluation comprise:

a first comparator (15) and a second comparator (16) both connected to the output of the amplifier element (3), a first AND gate (12) to produce an alarm signal, a second AND gate (17) to produce a trouble signal, an alarm transmission circuit consisting of a bistable switch (13) connected to the output of first AND gate (12) to transmit said alarm signal, and a trouble signal transmission circuit (18) connected to the output of second AND gate (17) to transmit a trouble signal, wherein said electronic control means for signal evaluation is adapted to increase the supply voltage (U) via the electronic means (5, 11) and transmit an alarm signal if at increased supply voltage a current flows which causes a voltage drop at a load resistor (2) to exceed a monitoring threshold (Us2), showing no significant reduction of the saturation current (Is) of the ionization measurement chamber (1) and transmit a trouble signal if at increased supply voltage a current flows which causes the voltage drop at said load resistor (2) to fall below the monitoring threshold (Us2), and showing a significant reduction of the saturation current (Is) of the ionization measurement chamber (1).

3. A fire alarm system comprising:

(a) control and indicating means (6) comprising an evaluation circuit comprising (i) threshold detection means (15, 16) for comparing an electrical signal characteristic to minimum and maximum limits and for producing an alarm or trouble signal, (ii) electronic means (5, 11) adapted to change the supply voltage (U) of an ionization smoke detector (7) having an ionization measurement chamber (1) to a first supply voltage and an increased second supply voltage, and (iii) electronic control means for signal evaluation adapted to compare the corresponding two currents measured at said two supply voltages with predetermined current values and to generate an alarm signal only if variations from the predetermined current values of the actual output signal of the amplifier element (3) caused by the increased second supply voltage demonstrates that there has been no significant reduction of the saturated current (Is) of said ionization measurement chamber (1) after the supply voltage has been increased to said second supply voltage; and (b) a plurality of ionization smoke detectors (7) being connected through signal lines (8, 9, 14) with said control and indicating means (6), each ionization smoke detector (7) comprising:

(i) said ionization measurement chamber (1) for producing an electrical signal having a characteristic indicative of a monitored condition, (ii) a radioactive source (10) to ionize the air in the ionization measurement chamber (1), and (iii) an evaluation circuit comprising (A) an amplifier element (3) to amplify the electrical signal from said ionization measurement chamber (1), and (B) converter means (19) for transmitting the amplified electrical signal to said control and indicating means (6).

4. A fire alarm system according to claim 3, wherein the electronic control means for signal evaluation comprises:

a first comparator (15) and a second comparator (16) both connected to the output of the amplifier element (3), a first AND gate (12) to produce an alarm signal, a second AND gate (17) to produce a trouble signal, an alarm transmission circuit consisting of a bistable switch (13) connected to the output of first AND gate (12) to transmit said alarm signal, and a trouble signal transmission circuit (18) connected to the output of second AND gate (17) to transmit a trouble signal, wherein said electronic control means for signal evaluation is adapted to increase the supply voltage (U) via the electronic means (5, 11) and transmit an alarm signal if at increased supply voltage a current flows which causes a voltage drop at a load resistor (2) to exceed a monitoring threshold (Us2), showing no significant reduction of the saturation current (Is) of the ionization measurement chamber (1) and transmit a trouble signal if at increased supply voltage a current flows which causes the voltage drop at said load resistor (2) to fall below the monitoring threshold (Us2), and showing a significant reduction of the saturation current (Is) of the ionization measurement chamber (1).

5. A fire alarm system comprising:

(a) control and indicating means (6) comprising an evaluation circuit comprising (i) threshold detection means (15, 16) for comparing an electrical signal characteristic to minimum and maximum limits and for producing an alarm or trouble signal, (ii) first electronic means (5) adapted to change the supply voltage (U) of an ionization smoke detector (7) having an ionization measurement chamber (1) to a first supply voltage and an increased second supply voltage, and (iii) electronic control means for the signal evaluation adapted to compare the corresponding two currents measured at said two supply voltages with predetermined current values and to generate an alarm signal only if variations from the predetermined current values of the actual output signal of the amplifier element (3) caused by the increased second supply voltage demonstrates that there has been no significant reduction of the saturated current (Is) of said ionization measurement chamber (1) after the supply voltage has been increased to said second supply voltage; and (b) a plurality of ionization smoke detectors (7) being connected through signal lines (8, 9, 14) with said control and indicating means (6), each ionization smoke detector (7) comprising:

(i) said ionization measurement chamber (1) for producing an electrical signal having a characteristic indicative of a monitored condition, (ii) a radioactive source (10) to ionize the air in the ionization measurement chamber (1), and (iii) an evaluation circuit comprising (A) an amplifier element (3) to amplify the electrical signal from said ionization measurement chamber (1), (B) converter means (19) for transmitting the amplified electrical signal to said control and indicating means (6), and (C) second electronic means (11) operatively associated with first electronic means (5) of control and indicating means (6) and adapted to change the supply voltage (U) of said ionization smoke detector (7) to two different supply voltages.

6. A first alarm system according to any one of claims 3-5, wherein said control and indicating means (6) comprise additional converter means (20) connected to the output of converter means (19) of ionization smoke detector (7).

7. An ionization smoke detector, comprising:

(i) an ionization measurement chamber (1) for producing an electrical signal having a characteristic indicative of a monitored condition, (ii) a radioactive source (10) to ionize the air in the ionization measurement chamber (1), and (iii) an evaluation circuit comprising:

(A) an amplifier element (3) to amplify the electrical signal from the ionization measurement chamber (1), and (B) threshold detection means (15, 16) for comparing the electrical signal characteristic to minimum and maximum limits and for producing an alarm or trouble signal, (C) electronic means (5, 11) adapted to change the supply voltage (U) of said ionization smoke detector (7) to a first supply voltage and an increased second supply voltage, and (D) electronic control means for signal evaluation adapted to compare the corresponding two currents measured at said two different supply voltages with predetermined current values and to transmit an alarm signal only if variations from the predetermined current values of the actual output signal of the amplifier element (3) caused by the increased second supply voltage demonstrates that there has been no significant reduction of the saturated current (Is) of said ionization measurement chamber (1) after the supply voltage has been increased to said second supply voltage.

8. An ionization smoke detector according to claim 7, wherein the electronic control means for signal evaluation comprise:

a first comparator (15) and a second comparator (16) both connected to the output of the amplifier element (3), a first AND gate (12) to produce an alarm signal, a second AND gate (17) to produce a trouble signal, an alarm transmission circuit consisting of a bistable switch (13) connected to the output of first AND gate (12) to transmit said alarm signal, and a trouble signal transmission circuit (18) connected to the output of second AND gate (17) to transmit a trouble signal, wherein said electronic control means for signal evaluation is adapted to increase the supply voltage via the electronic means (5, 11) and transmit an alarm signal if at increased supply voltage a current flows which causes a voltage drop at a load resistor (2) to exceed a monitoring threshold (Us2), showing no significant reduction of the saturation current (Is) of the ionization measurement chamber (1) and transmit a trouble signal if at increased supply voltage a current flows which causes the voltage drop at said load resistor (2) to fall below the monitoring threshold (Us2), and showing a significant reduction of the saturation current (Is) of the ionization measurement chamber (1).

9. In an ionization smoke detector system, a method for determining whether a possible alarm condition from an ionization smoke detector is a true alarm or a false alarm, comprising the steps of:

operating said ionization detector with a first supply voltage and comparing a resulting chamber current to a first predetermined value to detect a possible alarm condition, operating said ionization detector at a second, higher supply voltage and comparing the resulting chamber current to a second predetermined value to detect a significant change in the saturation current of said chamber, and signaling a true alarm condition in response to said possible alarm condition only if said predetermined change in the saturation current is not detected.

10. A method according to claim 9 wherein said method further comprises signaling a trouble condition in said smoke detector system in response to detection of said change in the saturation current.

11. A method according to claim 9 wherein said step of operating said ionization detector at a second, higher supply voltage is performed in response to detection of said possible alarm condition.

12. A method according to claim 9 wherein said possible alarm condition is detected when said chamber current is below said first predetermined value and said change in the saturation current is detected when said chamber current at said higher voltage is below a second predetermined value.

* * * * *

UNITED STATES PATENT AND TRADEMARK OFFICE

CERTIFICATE OF CORRECTION

PATENT NO. : 5,212,470

DATED : May 18, 1993

INVENTOR(S) : Marc Thuillard

It is certified that error appears in the above-identified patent and that said Letters Patent is hereby corrected as shown below:

Col. 1, line 55, "false slits" should read --false alarms caused by fast air currents by redesigning the air entry slits--;

Col. 6, line 12, "of i the" should read --of the--;

Col. 11, line 32 and 33, "to transmit" should read --generate--

Signed and Sealed this

First Day of March, 1994

Bruce Lehman

*Attest:*

BRUCE LEHMAN

*Attesting Officer*

*Commissioner of Patents and Trademarks*